US007076198B2

(12) United States Patent
Kim et al.

(10) Patent No.: US 7,076,198 B2
(45) Date of Patent: Jul. 11, 2006

(54) FIXING DEVICE OF AN IMAGE FORMING APPARATUS HAVING A HEAT TRANSFER UNIT

(75) Inventors: Hwan-guem Kim, Seoul (KR); Durk-hyun Cho, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/601,566

(22) Filed: Jun. 24, 2003

(65) Prior Publication Data

US 2004/0062578 A1 Apr. 1, 2004

(30) Foreign Application Priority Data

Sep. 30, 2002 (KR) ..... 10-2002-0059367

(51) Int. Cl.
*G03G 15/20* (2006.01)

(52) U.S. Cl. ..... 399/330; 219/216

(58) Field of Classification Search ..... 399/320, 399/328, 329, 330, 335, 336; 219/216
See application file for complete search history.

(56) References Cited

U.S. PATENT DOCUMENTS

| | | | | |
|---|---|---|---|---|
| 3,452,181 | A * | 6/1969 | Stryjewski | 219/216 |
| 3,465,122 | A * | 9/1969 | Siegfried | 219/216 |
| 3,669,706 | A * | 6/1972 | Sanders et al. | 430/126 |
| 3,811,828 | A * | 5/1974 | Ohta et al. | 432/227 |
| 4,163,892 | A * | 8/1979 | Komatsu et al. | 219/216 |
| 4,435,069 | A * | 3/1984 | Sato | 399/336 |
| 5,499,089 | A * | 3/1996 | Tsukamoto et al. | 399/328 |
| 5,933,695 | A * | 8/1999 | Henry et al. | 399/333 |
| 6,456,819 | B1 * | 9/2002 | Abe et al. | 399/329 |
| 6,649,874 | B1 * | 11/2003 | Eskey | 219/216 |

FOREIGN PATENT DOCUMENTS

JP 07287461 A * 10/1995

* cited by examiner

*Primary Examiner*—Robert Beatty
(74) *Attorney, Agent, or Firm*—Staas & Halsey LLP

(57) ABSTRACT

A fixing device of an image forming apparatus includes a heat roller and a pressure roller. The heat roller includes a roller support frame, a film tube, and a heat transfer unit. The roller support frame is fixedly installed with the heat roller. The roller support frame supports the film tube. The heat transfer unit transfers radiation energy toward a part of the film tube that is in contact with the pressure roller.

18 Claims, 2 Drawing Sheets

FIXING DEVICE OF AN IMAGE FORMING APPARATUS HAVING A HEAT TRANSFER UNIT

CROSS-REFERENCE TO RELATED APPLICATIONS

This application claims the priority of Korean Patent Application No. 2002-59367, filed Sep. 30, 2002 in the Korean Intellectual Property Office, the disclosure of which is incorporated herein by reference.

BACKGROUND OF THE INVENTION

1. Field of the Invention

The present invention relates to a fixing device, and more particularly to a fixing device of an image forming apparatus, in which heat is focused on a position where a heat roller and a pressure roller engage with each other, thereby shortening a warming-up time of the heat roller and enhancing a fixing efficiency.

2. Description of the Related Art

Generally, an image forming apparatus such as a printer, a copying machine, and a composite machine transfers a toner image developed on a photo-sensitive medium onto a paper using an image transfer roller and then, heats and compresses the toner image while passing the paper through a fixing device, thereby fixing the image onto the paper toner.

A conventional fixing device includes a heat roller 51 and a press roller 61 as shown in FIG. 1.

Typically, the pressure roller 61 includes a silicon rubber 63, within which a shaft 62 made of stainless steel is fitted.

A halogen lamp 58 is provided within the heat roller 51, and an aluminum pipe 56 is used as a supporting pipe because of its high heat conductivity, low price, and good machineability. The aluminum pipe 56 is formed with a Teflon-coated toner release layer 52 on its external surface and formed with a light-to-heat converting layer 54 to absorb a radiation energy emitted from the halogen lamp 58 on an internal surface of the converting layer 54.

The conventional fixing device operates as follows.

When electric power is applied, the lamp 58 is lighted and emits the radiation energy. The emitted radiation energy arrives at the light-to-heat converting surface 54 provided on the internal surface of the aluminum pipe 56 and is converted into heat energy, thereby increasing a temperature of an entire area of the aluminum pipe 56.

The heated aluminum pipe 56 transfers heat to the surface of the heat roller 51, and the paper moves in a direction indicated by an arrow 67 and the heat roller 51 and the pressure roller 61 heat and compress the paper when the paper passes between the heat roller 51 and the pressure roller 61, thereby fixing a toner image 66 on the paper.

The conventional fixing device of the image forming apparatus has a problem in that the fixing device requires a long warming-up time for copying or printing because an entire area of the aluminum pipe 56 should be heated.

In particular, a low-speed laser printer set (10–14 ppm), which uses a halogen lamp with a capacity of 500–600 watts and an aluminum pipe with a diameter of 15–20 mm, usually requires a warming-up time of 35–40 seconds and even requires 2–3 minutes for printing free of a fixation problem under a low temperature and a low moisture circumstance, at which heat radiation efficiency is low.

Furthermore, the conventional fixing device, which requires a long warming-up time, has a disadvantage in that the fixing device has a high energy consumption because it has to be supplied with electric power in order to continuously maintain a predetermined temperature during a stand-by mode for a subsequent rapid printing.

SUMMARY OF THE INVENTION

Various aspects and advantages of the invention will be set forth in part in the description that follows and, in part, will be obvious from the description, or may be learned by practice of the invention.

Accordingly, the present invention has been made to solve the above-mentioned problems occurring in the prior art, and an aspect of the present invention is to provide a fixing device that requires a reduced warm-up time to warm a heat roller to a predetermined fixed temperature.

In addition, according to an aspect of the present invention, there is provided a fixing device of an image forming apparatus, which has an improved heat efficiency of fixing.

In order to accomplish the above aspects, there is provided a fixing device of an image forming apparatus which includes a heat roller and a pressure roller wherein the heat roller includes: a roller support frame fixedly installed within the heat roller; a film tube supported by the roller support frame; and a heat transfer unit transferring radiation energy toward a part of the film tube that is in contact with the pressure roller.

According to an aspect of the present invention, the film tube rotates in a linear speed which is same as that of the pressure roller, and the heat transfer unit is fixedly installed in the roller support frame.

The heat transfer unit includes: a halogen lamp generating light energy, a light-to-heat converting unit converting the light energy emitted from the halogen lamp into heat energy, and a radiation energy converging unit converging the light energy emitted from the halogen lamp onto the light-to-heat converting unit.

Herein, the radiation energy converging unit is installed to be in contact with the top of the light-to-heat converting unit. The radiation energy converging unit includes: a quartz glass plate transmitting the light energy emitted from the halogen lamp, and a reflector reflecting the light energy emitted from the halogen lamp towards the quartz glass plate.

According to an aspect of the present invention, the reflector is installed above the quartz glass plate to enclose the halogen lamp.

In addition, thermal grease may be applied or glass may be coated on the external surface of the light-to-heat converting unit, which is formed from a black body having an excellent absorption property for radiated light.

According to an aspect of the present invention, the thickness of the quartz glass plate is not greater than 5 mm.

According to an aspect of the fixing device of an image forming apparatus of the present invention constructed as described above, warming-up time can be shortened and consumption of electric power can be reduced because a light-to-heat converting unit and a quartz glass plate with good light transmittance and low heat conductivity are used.

According to an aspect of the present invention, there is provided an image forming apparatus to form a toner image on an image forming medium, including: a heat roller; a pressure roller, wherein a paper passes between the heat roller and the pressure roller; and a fixing device focusing heat on a position where the heat roller and the pressure roller engage with each other to fix a toner image onto the image forming medium.

According to an aspect of the present invention, there is provided an image forming apparatus to form a toner image on an image forming medium, including: a heat roller; a pressure roller, wherein a paper passes between the heat roller and the pressure roller; and a fixing device focusing heat on a position where the heat roller and the pressure roller engage with each other to fix a toner image onto the image forming medium.

BRIEF DESCRIPTION OF THE DRAWINGS

The above and/or other aspects, features and advantages of the present invention will be more apparent from the following detailed description taken in conjunction with the accompanying drawings, in which.

DETAILED DESCRIPTION OF THE PREFERRED EMBODIMENTS

Figure 1:
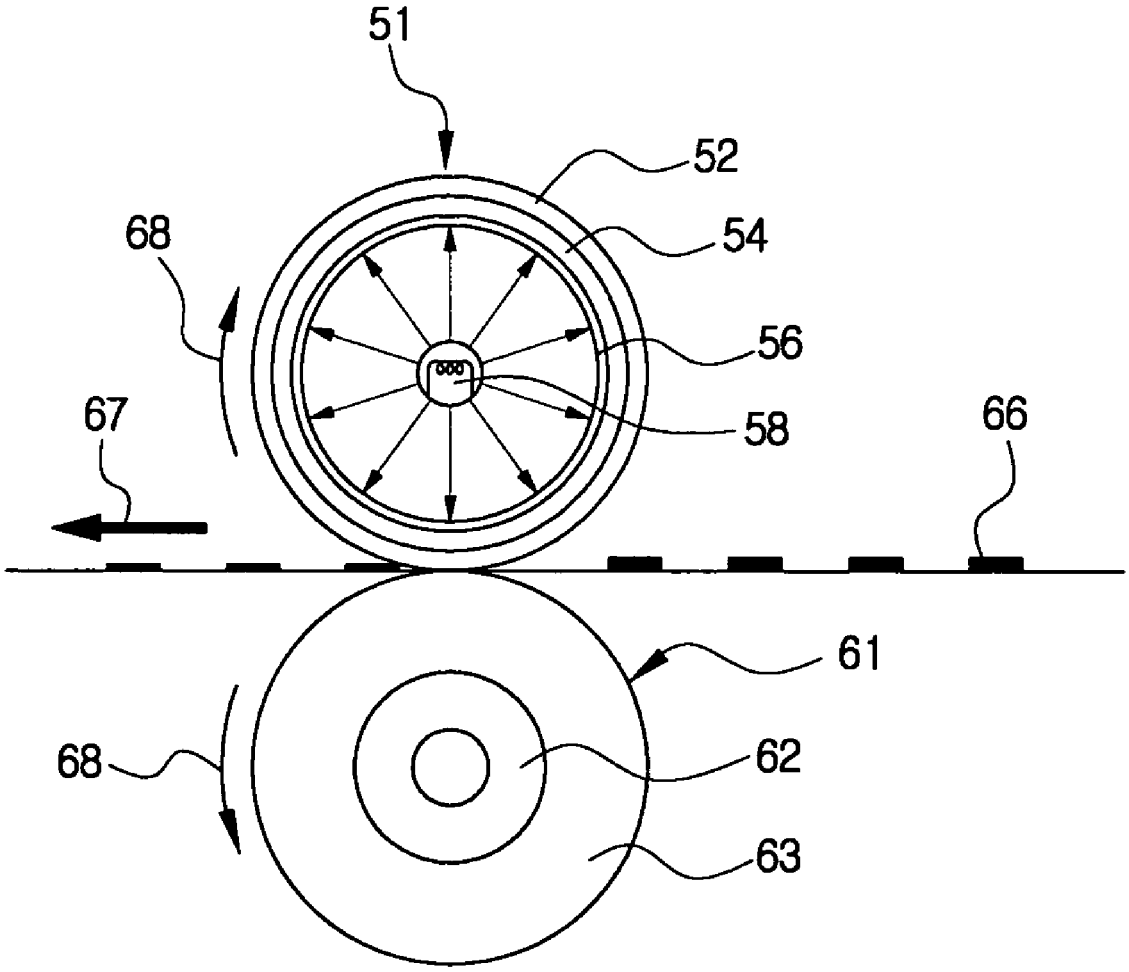
FIG. 1 (PRIOR ART)
FIG. 1 is a cross-section view schematically showing a conventional fixing device of an image forming apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
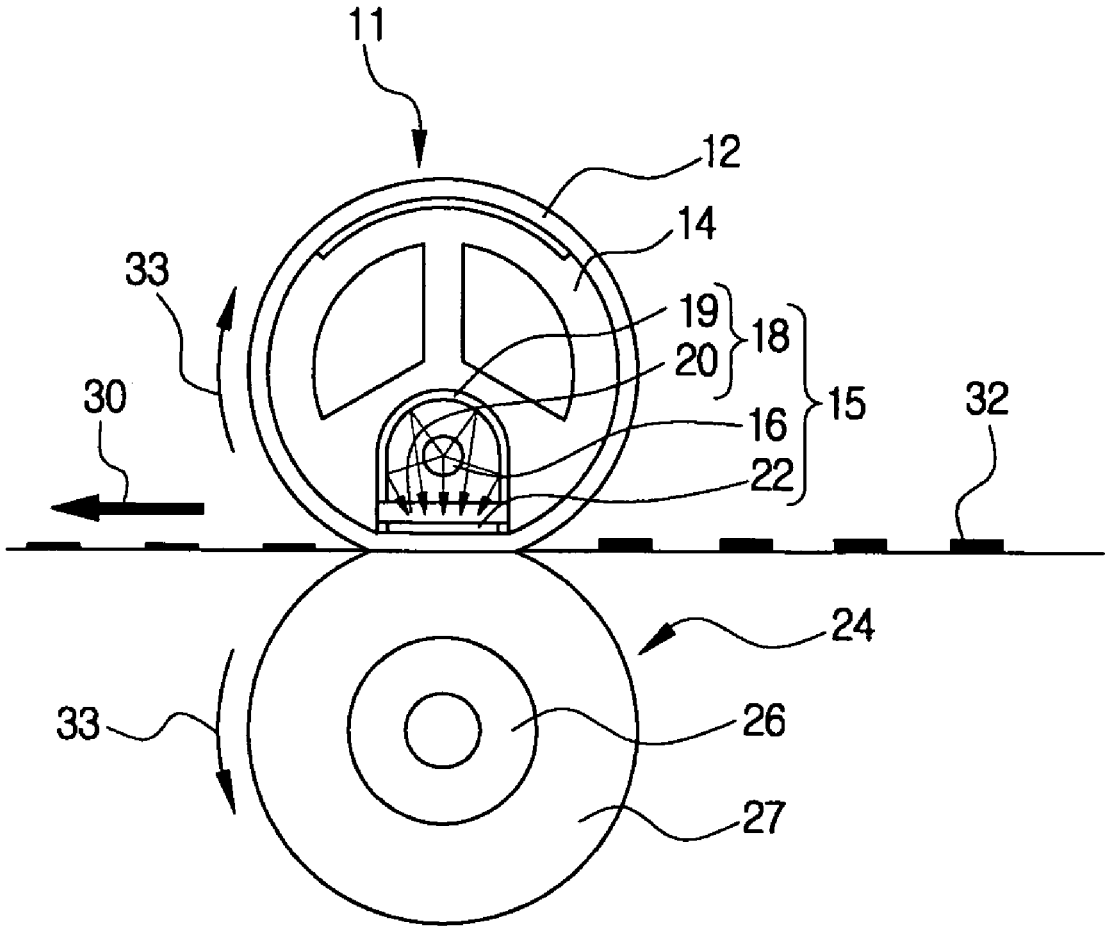
FIG. 2 is a cross-section view showing a fixing device of an image forming apparatus, in accordance with an aspect of the present invention.

Referring to FIG. 2 which shows a fixing apparatus of an image forming apparatus, according to an aspect of the present invention. The image forming apparatus includes a heat roller 11 and a pressure roller 24.

The pressure roller 24 includes a shaft 26 made of stainless steel, and an elastic silicon rubber 27 which encompasses the shaft 26.

The heat roller 11 includes a film tube 12, a roller support frame 14, and a heat transfer unit 15. The film tube 12 forms an outermost layer of the heat roller 11 and rotates in a linear speed same with that of the pressure roller 24. The film tube 12 may be formed of polyimide which is highly heat-resistant, and may be coated with PFA or PTFE on its surface, so that a toner image can be excellently formed.

The roller frame 14 supports the film tube 12 to be smoothly rotated within the film tube 12 and encompasses and protects the heat transfer unit 15. The roller support frame 14 is secured within the heat roller 11 together with the heat transfer unit 15. Among the components of the heat roller 11, only the film tube 12 is engaged and rotated with the pressure roller 24. In addition, the roller support frame 14 is constructed from an injection-molded heat resistant structure which is not deformed at a temperature below 240° C.

As shown in FIG. 2, the heat transfer unit 15 includes a halogen lamp 16 as a heat-generating source which emits radiation energy, a black body 22 to convert the radiation energy into heat energy, and a radiation energy converging unit 18.

The halogen lamp 16 is a conventional lamp and is secured to the radiation energy converging unit 18. The black body 22 is an example of a light-to-heat converting element. Although the light-to-heat converting element may be formed of various materials, the black body 22 may be employed to absorb substantially all of the radiated light rays. A glass coating or a thermal grease may be applied on an external surface of the light-to-heat element, so that the film tube 12 can be smoothly slid.

The radiation energy converging unit 18 includes a reflector 19 and a quartz glass plate 20, as shown in FIG. 2.

The reflector 19 is installed to encompass a top and both sides of the halogen lamp 16 and to be spaced from the halogen lamp 16. As shown in FIG. 2, the reflector 19 has an inverted U-shape and reflects the radiation energy emitted from the halogen lamp 16 to an underside of the halogen lamp 16. However, according to an aspect of the present invention, the shape of the reflector 19 may vary and the reflector 16 may take any form, provided it can reflect the light emitted from the halogen lamp 16 to the underside of the halogen lamp 16 toward a portion which is in contact with the pressure roller 24.

The quartz glass plate 20 is installed below the halogen lamp 16 to be spaced from the halogen lamp 16 and to be in contact with a top of the black body 22. In addition, the thickness of the quartz glass plate 20, in one aspect of the present invention, may not exceed 5 mm, so that the light-to-heat converting element can be heated to a fixing temperature within a short length of time.

Such a quartz glass plate has an advantage in that the glass plate has a light transmittance not less than 80%, thereby considerably shortening the time required for raising the temperature of the black body 22 to a predetermined temperature.

The fixing device constructed as described in the above, according to an aspect of the present invention, is operated as follows.

If electric power is applied, the halogen lamp 16 is heated and then emits radiation energy. The emitted radiation energy is reflected by the reflector 19 and converged onto the quartz glass plate 20, where the reflector 19 is positioned below the quartz glass plate 20.

Because the quartz glass plate 20 has a good light transmittance, most of the light is transferred to the black body 22, which is in contact with a lower surface of the quartz glass plate 20, and the transferred radiation energy is converted into the heat energy while being absorbed into the black body 22.

The quartz glass plate 20 has very poor heat conductivity as compared to other materials, such as aluminum. Therefore, the heat energy converted by the black body 22 is hardly transferred through the quartz glass plate 20 and, thus, most of the heat energy is used to increase the temperature of the pressure roller 24 and to fix a toner image onto the paper which passes between the heat roller 11 and the press roller 24.

Meanwhile, the film tube 12 is supported by the roller support frame 14 and is rotated while being engaged with the pressure roller 24 with a predetermined pressure. The film tube 12 receives heat from the black body and transfers the heat to the paper.

That is, as shown in FIG. 2, the heat roller 11 rotates in a direction indicated by the arrow 33, and the paper, which receives the toner image while passing between the photosensitive material (not shown) and an image transfer roller (not shown) of the image forming apparatus, passes between the heat roller 11 and the pressure roller 24 in a direction indicated by the arrow 30. As a result, because the heat roller 11 locally transfers the heat only onto the paper, heating efficiency is excellent, and, furthermore, because the quartz glass plate 20 with good light transmittance and poor heat conductivity is employed, the warm-up time of the heat roller can be shortened.

While the invention has been shown and described with reference to certain preferred embodiments thereof, it will be understood by those skilled in the art that various changes and modifications in form and details may be made therein without departing from the spirit and scope of the invention as defined by the appended claims. Therefore, all of such changes, modifications and equivalents thereof are intended to be included within the scope of the present invention.

What is claimed is:

1. A fixing device of an image forming apparatus comprising a heat roller and a pressure roller, the heat roller comprising:

a roller support frame fixedly installed within the heat roller;

a film tube supported by the roller support frame; and a heat transfer unit transferring radiation energy toward a part of the film tube that is in contact with the pressure roller wherein the heat transfer unit comprises:

a halogen lamp generating light energy, a blackbody converting the light energy emitted from the halogen lamp into heat energy, and a radiation energy converging unit converging the light energy emitted from the halogen lamp onto the blackbody, wherein the radiation energy converging unit includes a material coated on an external surface of the blackbody, the material comprising a material with a high light transmittance and a low heat conductivity as compared to the blackbody.

2. The fixing device according to claim 1, further comprising:

a thermal grease applied on an external surface of the blackbody.

3. A fixing device of an image forming apparatus comprising a heat roller and a pressure roller, the heat roller comprising:

a roller support frame fixedly installed within the heat roller;

a film tube supported by the roller support frame; and a heat transfer unit transferring radiation energy toward a part of the film tube that is in contact with the pressure roller, wherein:

the heat transfer unit comprises:

a halogen lamp generating light energy, a blackbody converting the light energy emitted from the halogen lamp into heat energy, and a radiation energy converging unit converging the light energy emitted from the halogen lamp onto the blackbody the radiation energy converging unit comprises:

a quartz glass plate transmitting the light energy emitted from the halogen lamp, and a reflector reflecting the light energy emitted from the halogen lamp towards the quartz glass plate.

4. The fixing device according to claim 3, wherein the reflector is installed above the quartz glass plate to enclose the halogen lamp.

5. The fixing device according to claim 3, wherein the blackbody has an absorption property corresponding to the emitted light energy.

6. The fixing device according to claim 3, wherein the thickness of the quartz glass plate is not greater than 5 mm.

7. An image forming apparatus to form a toner image on an image forming medium, comprising:

a heat roller;

a pressure roller, wherein a paper passes between the heat roller and the pressure roller;

a focusing device focusing heat on a position where the heat roller and the pressure roller engage with each other to fix a toner image onto the image forming medium;

wherein:

the heat roller comprises:

a film tube forming an outermost layer of the heat roller and rotating in a linear speed same as that of the heat roller, a roller support frame supporting the film tube, and a heat transfer unit;

the heat transfer unit comprises:

a halogen lamp emitting radiation energy, and a black-body converting the radiation energy into heat energy; and a radiation energy converging unit comprising a reflector having a top and both sides of the halogen lamp and spaced from the halogen lamp, and a quartz glass plate installed below the halogen lamp and spaced from the halogen lamp and in contact with a top of the black body.

8. The image forming apparatus of claim 7, the film tube is formed of polyimide and is coated with PFA or PTFE on a surface thereof.

9. The image forming apparatus of claim 7, wherein the roller support frame is secured with the heat roller together with the heat transfer unit.

10. The image forming apparatus of claim 7, wherein only the film tube is engaged and rotated with the pressure roller.

11. The image forming apparatus of claim 7, wherein the black body is a light-to-heat converting element comprising a glass coating or a thermal grease on an external surface thereof.

12. The image forming apparatus of claim 7, wherein the reflector comprises an inverted U-shape and reflects the radiation energy emitted from the halogen lamp to an underside of the halogen lamp.

13. The image forming apparatus of claim 7, wherein the quartz glass plate comprises a thickness not greater than 5 mm so that the light-to-heat converting element is heated to a fixing temperature within a short length of time.

14. The image forming apparatus of claim 7, wherein:

the radiation energy emitted by the halogen lamp is reflected by the reflector and converged onto the quartz glass plate, and the quartz glass plate is disposed between the reflector and the black-body such that the radiation energy converged onto the quartz glass plate is transmitted to the black-body.

15. The image forming apparatus of claim 14, wherein the quartz glass plate comprises good light transmittance and most of the radiation energy is transferred to the black body, which is in contact with a lower surface of the quartz glass plate, and the transferred radiation energy is converted into heat energy while being absorbed by the black-body.

16. The image forming apparatus of claim 15, wherein the quartz glass plate has a heat conductivity where most of the heat energy converted by the black-body is used to increase a temperature of the pressure roller to fix the toner image onto the image forming medium.

17. The image forming apparatus of claim 16, wherein the film tube is supported by the roller support frame and is rotated while engaged with the pressure roller with a predetermined pressure.

18. The image forming apparatus of claim 17, wherein the film tube receives the heat from the black-body and transfers the heat to the image forming medium.

* * * * *